US006327943B1

(12) United States Patent
Wrigley et al.

(10) Patent No.: US 6,327,943 B1
(45) Date of Patent: Dec. 11, 2001

(54) LAMINATED SELF-ADJUSTING PLIERS

(75) Inventors: Harold K. Wrigley, Sewickley; Frank Li, Pittsburgh; Jeffrey B. Hile, Wexford, all of PA (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/259,842

(22) Filed: Mar. 1, 1999

Related U.S. Application Data

(60) Provisional application No. 60/076,510, filed on Mar. 2, 1998.

(51) Int. Cl.[7] ..... B25B 7/04

(52) U.S. Cl. ..... 81/413; 81/421; 81/405; 81/409; 81/900

(58) Field of Search ..... 81/413, 418, 421, 81/393, 405, 407–409, 409.5, 411–414, 416, 357, 900, 313, 406, 382; 76/114, 119, DIG. 6; 72/410, 409.12

(56) References Cited

U.S. PATENT DOCUMENTS

| | | | | |
|---|---|---|---|---|
| D. 329,180 | | 9/1992 | Warheit | D8/52 |
| 330,369 | | 11/1885 | Barnes . | |
| 434,409 | | 8/1890 | Sutton . | |
| 474,987 | | 5/1892 | Church . | |
| 610,831 | | 9/1898 | Roberts . | |
| 1,639,183 | | 8/1927 | Ingram . | |
| 1,717,725 | | 6/1929 | McGill . | |
| 2,066,716 | | 1/1937 | Cruickshank | 81/44 |
| 2,368,906 | | 2/1945 | Westman | 30/190 |
| 2,369,346 | | 2/1945 | Gearhart | 81/87 |
| 2,531,285 | | 11/1950 | Manspeaker | 81/84 |
| 2,532,659 | * | 12/1950 | Burns | 81/371 |
| 2,553,400 | | 5/1951 | Blair | 81/84 |
| 2,595,579 | | 5/1952 | Hawkins | 81/18 |
| 3,220,241 | | 11/1965 | Miller | 72/446 |
| 3,608,405 | | 9/1971 | Schmidt | 81/356 |
| 4,269,089 | | 5/1981 | Hastings | 81/410 R |

(List continued on next page.)

FOREIGN PATENT DOCUMENTS

| | | |
|---|---|---|
| 493112 | 5/1950 | (BE) . |
| 958459 | 2/1957 | (DE) . |
| 969920 | 7/1958 | (DE) . |
| 1060330 | 6/1959 | (DE) . |
| 2031661 | 2/1972 | (DE) . |
| 2052020 | 3/1971 | (FR) . |
| 2456592 | 12/1980 | (FR) . |
| 1265295 | 3/1972 | (GB) . |

*Primary Examiner*—D. S. Meislin
(74) *Attorney, Agent, or Firm*—Howrey, Simon, Arnold & White, LLP

(57) ABSTRACT

The present invention comprises a number of innovations in the design of self-adjusting pliers. A self-adjusting pliers tool formed of laminated sheet metal construction is provided with separately fabricated cast steel jaws that provide improved strength and durability relative to laminated jaws. Techniques are also disclosed for casting the steel jaws and for treating them to achieve improved surface hardness and corrosion resistance.

In certain embodiments, the jaw and the jaw end of the laminated handle are designed to interlock to prevent the jaw from sliding out of position. In certain other embodiments, a "self-energizing" feature is provided in which the shape and tooth configuration of the jaw, and the angle of the jaw end of the pliers, cooperate to keep the tool secured to a workpiece even after the upward squeezing force on the lower handle is released. In addition, a non-engaging feature is disclosed, which allows the user of the tool to squeeze the handles of the tool together to a comfortable gripping range when a large workpiece is held in the jaws.

7 Claims, 18 Drawing Sheets

U.S. PATENT DOCUMENTS

| | | | | |
|---|---|---|---|---|
| 4,283,933 | * | 8/1981 | Wiener | 81/419 X |
| 4,353,240 | * | 10/1982 | Undin et al. | 81/417 X |
| 4,386,973 | | 6/1983 | Kawka | 148/16.5 |
| 4,438,669 | | 3/1984 | Hastings | 81/410 R |
| 4,651,598 | | 3/1987 | Warheit | 81/407 |
| 4,662,252 | | 5/1987 | Warheit | 81/341 |
| 4,802,390 | | 2/1989 | Warheit | 81/341 |
| 4,893,530 | | 1/1990 | Warheit | 81/409.5 |
| 5,012,666 | * | 5/1991 | Chen et al. | 81/402 X |
| 5,060,543 | | 10/1991 | Warheit | 81/409 |
| 5,113,727 | * | 5/1992 | Foster | 81/421 X |
| 5,140,876 | | 8/1992 | Fields | 81/408 |
| 5,351,584 | | 10/1994 | Warheit | 81/407 |
| 5,377,567 | | 1/1995 | Sorensen | 81/426 |
| 5,385,072 | | 1/1995 | Neff | 81/405 |
| 5,485,641 | * | 1/1996 | Machmeier et al. | 81/421 X |
| 5,499,936 | | 3/1996 | McElroy, Jr. | 440/83 |
| 6,026,671 | * | 2/2000 | Battenfeld | 81/313 X |

* cited by examiner

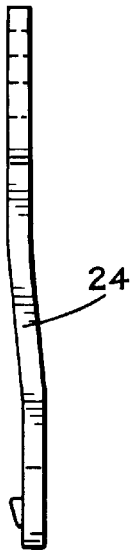
FIG. 6A
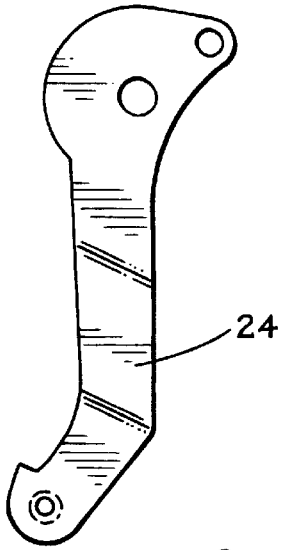
FIG. 6B
FIG. 9
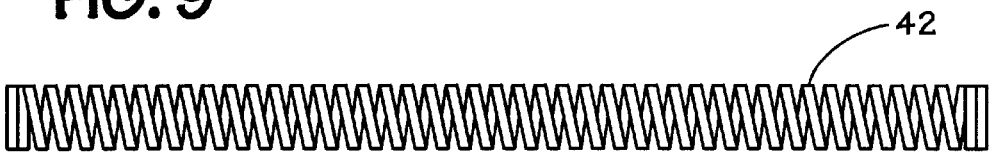
FIG. 10A
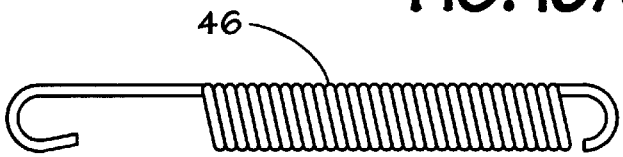
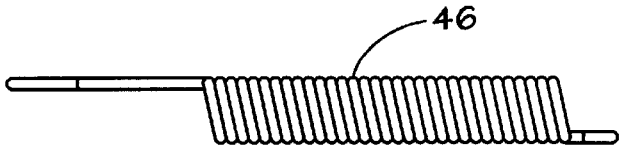
FIG. 10B

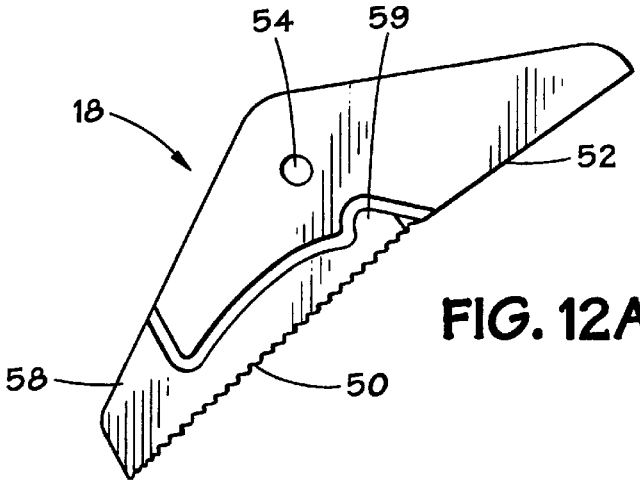
FIG. 12A
FIG. 12B
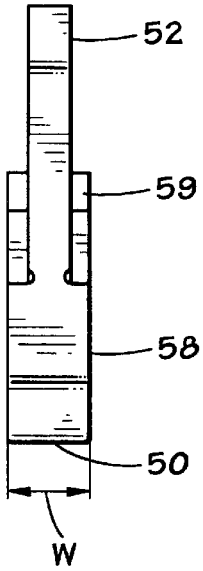
FIG. 12C
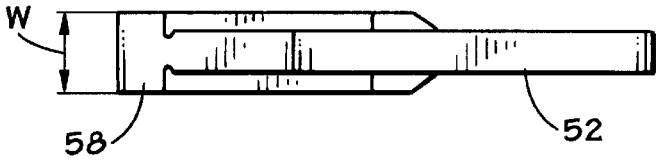
FIG. 14A
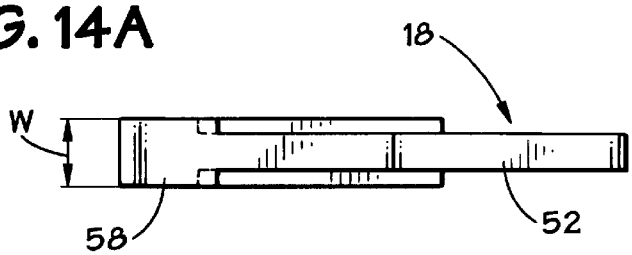
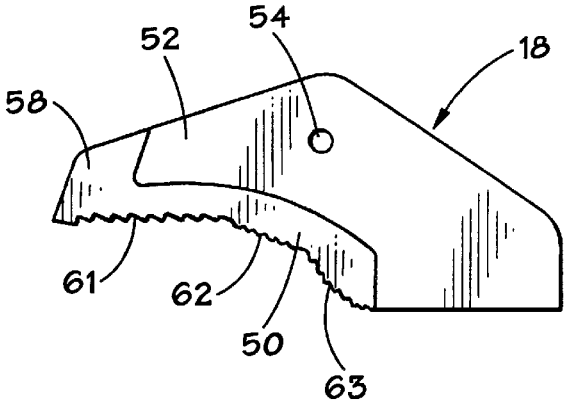
FIG. 14B

MICROHARDNESS MEASUREMENTS

| DISTANCE FROM SURFACE | KNOOP | CONVERTED TO ROCKWELL 'C' |
|---|---|---|
| JAW 1P | | |
| .002" | 973 | 70.0 |
| .004" | 869 | 66.0 |
| .006" | 658 | 56.4 |
| .010" | 605 | 53.6 |
| CORE | 578 | 52.1 |
| CASE DEPTH = .006" | | |
| JAW 2P | | |
| .002" | 973 | 70.0 |
| .004" | 898 | 67.1 |
| .006" | 671 | 57.0 |
| .010" | 605 | 53.6 |
| CORE | 588 | 52.7 |
| CASE DEPTH = .006" | | |
| JAW 3P | | |
| .002" | 985 | 70.0+ |
| .004" | 909 | 67.5 |
| .006" | 691 | 58.0 |
| .010" | 583 | 52.4 |
| CORE | 543 | 50.1 |
| CASE DEPTH = .006" | | |
| JAW 4P | | |
| .002" | 1009 | 70.0+ |
| .004" | 879 | 66.3 |
| .006" | 671 | 57.0 |
| .010" | 578 | 52.1 |
| CORE | 578 | 52.1 |
| CASE DEPTH = .006" | | |

FIG. 20A

MICROHARDNESS MEASUREMENTS

| DISTANCE FROM SURFACE | KNOOP | CONVERTED TO ROCKWELL 'C' |
|---|---|---|
| JAW 2T | | |
| .002" | 997 | 70.0+ |
| .004" | 888 | 66.7 |
| .006" | 677 | 57.3 |
| .010" | 616 | 54.2 |
| CORE | 588 | 52.7 |
| CASE DEPTH = .006" | | |
| JAW 3T | | |
| .002" | 985 | 70.0+ |
| .004" | 898 | 67.1 |
| .006" | 664 | 56.7 |
| .010" | 605 | 53.6 |
| CORE | 573 | 51.8 |
| CASE DEPTH = .006" | | |
| JAW 4T | | |
| .002" | 919 | 67.9 |
| .004" | 832 | 64.4 |
| .006" | 658 | 56.4 |
| .010" | 622 | 54.6 |
| CORE | 588 | 52.7 |
| CASE DEPTH = .006" | | |

FIG. 20B

LAMINATED SELF-ADJUSTING PLIERS

This application claims the benefit of U.S. Provisional Application No. 60/076,510, filed Mar. 2, 1998.

BACKGROUND OF THE INVENTION

Self-adjusting pliers are described, for example, in U.S. Pat. No. 4,651,598, which is incorporated by reference herein in its entirety. Self-adjusting, or "auto-grip," pliers such as disclosed in this patent provides the capability of one-handed adjustment, wherein the pliers jaws automatically adjust to the size of a work piece in response to a user's manual closing action on the pliers' handles.

Many prior art hand tools, such as the pair of pliers disclosed in the 4,651,598 patent, are produced via forging operations, wherein the pliers' main body members are of essentially one-piece, forged steel construction. Usually, the tool begins as pieces of bar stock that are forged to obtain the basic shape of the pliers' body members. The roughly shaped pliers body members are then machined to get the final, desired tool shape. These multiple operations are inefficient, resulting in waste and added labor costs which, in turn, increase the cost of the finished tool. To partially compensate for the costs of the waste produced with forged construction, inexpensive materials, such as high-carbon steel, are typically used for fabricating tools such as pliers. This, however, may result in pliers, especially pliers jaws, that do not have the proper hardness characteristics required for many applications.

U.S. Pat. Nos. 4,662,252 and 5,351,584, incorporated herein by reference in their entirety, disclose self-adjusting pliers that operate in a similar manner. However, the main body members, including the pliers jaws, are constructed out of laminated sheet metal stampings, rather than one-piece, forged steel. While this may result in a cost and efficiency improvement over tools constructed via forging processes, the laminated construction does not provide pliers jaws having the hardness characteristics desired for many applications.

A pliers jaw assembled entirely of laminated sheet metal stampings rather than a single forged piece must be held together by fasteners such as rivets. Shear stresses placed on the jaw during use of the pliers tend to concentrate in the fasteners, sometimes causing them to fail. This difficulty would be somewhat intensified if the jaws of the pliers were made of stronger material, as suggested above, because the fasteners holding the jaw to the handle would become the weak point in the tool. Thus a complete solution requires that the handle carry the shear stresses from the jaw directly rather than through intervening fasteners or other small cross-section components.

A further difficulty sometimes encountered with some self-adjusting pliers of the type described above is that the locking mechanism of the jaw can sometimes engage when the tool is in its full open position, allowing the tool to stick or jam in that position.

Thus, a need exists for a pair of self-adjusting pliers that addresses the shortcomings of the prior art.

SUMMARY OF THE INVENTION

In one aspect of the present invention, an improved pliers tool is disclosed. The tool comprises upper and lower handle assemblies, each of laminated construction and having a first end comprising at least two layers. A jaw fabricated by a casting process is disposed between the layers of each handle assembly at its first end. Further aspects of the invention include preferred details of the fabrication technique and a replacement jaw for self-adjusting pliers tools produced by the technique.

In another aspect of the invention, the cast jaw comprises an extension portion of the jaw, by which the jaw is held between the handle end layers; a toothed gripping portion wider than the extension portion; and handle contact surfaces disposed opposite the gripping surface on either side of the extension portion. The handle contact surfaces allow the handle ends to support a somewhat wider jaw and to bear some of the load transmitted by the jaw so that the entire load is not concentrated at the fastener holding the jaw to the handle end.

In still another aspect of the invention, the jaw end of the laminated handle assembly is shaped with a notch adapted to receive a projecting edge of the cast jaw. This additional contact surface helps prevent the jaw from sliding and distributes shear stresses to the handle assembly that would otherwise be borne predominantly by the fastener holding the jaw to the handle end.

In still another aspect, the pliers tool is equipped with a nonengaging feature that prevents the pliers' locking mechanism from engaging when the pliers jaws grasp a large object. The feature comprises an offset segment of the elongated handle slot in which the locking pawl travels. The biasing features of the tool that drive the pliers to the full open position also move the locking pawl into the offset segment, causing it to move out of contact with the locking track on the far side of the slot. Because the pawl does not lock the handles in position, the user can continue to squeeze the handles together until they reach a predetermined separation that is comfortable for the user to grip and substantially independent of the size of the object.

BRIEF DESCRIPTION OF THE DRAWINGS

Other objects and advantages of the invention will become apparent upon reading the following detailed description and upon reference to the drawings in which:

FIGS. 4E–1, 4E–2, 5E–1, and 5E–2 disclose handle grips.

FIGS. 6A and 6B are assembly drawings, illustrating a specific embodiment of a tension arm for a self-adjusting pliers in accordance with aspects of the present invention;

FIG. 9 illustrates an exemplary slotted lever compression spring in accordance with an embodiment of the present invention;

FIGS. 10A and 10B illustrate an exemplary pivot lever extension spring in accordance with an embodiment of the present invention;

FIGS. 12A–12C illustrate an embodiment of an upper jaw in accordance with the present invention;

FIGS. 14A-14E and 15A–15D illustrate another embodiment of upper and lower jaws, respectively, having a self-energizing feature.

FIG. 20 is a table displaying microhardness measurements for a sampling of pliers jaws fabricated in accordance with aspects of the present invention.

Figure 1:
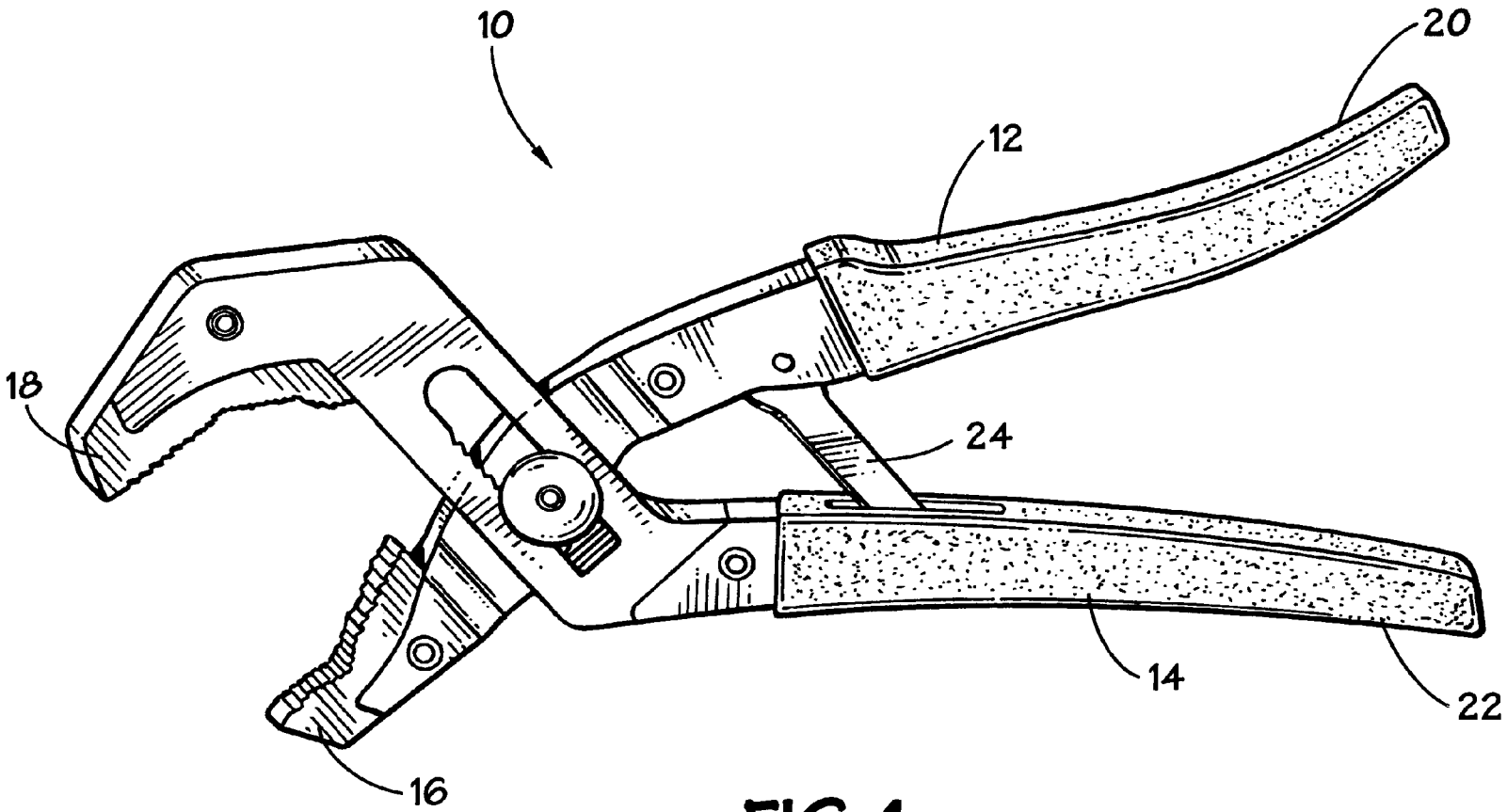
FIG. 1 is a perspective view of an embodiment of a self-adjusting pliers in accordance with an embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined herein.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The operation and general construction of the handle portions of the pair of pliers disclosed herein is described in detail in the patents referenced in the Background of the Invention section above, and further, in U.S. Pat. Nos. 4,802,390; 4,893,530; and 5,060,543. Each of these patents is incorporated by reference herein in its entirety.

FIG. 1 illustrates a perspective view of a self-adjusting pliers in accordance with an embodiment of the present invention. In general, the self-adjusting pliers 10 includes an upper handle assembly 12 and a lower handle assembly 14. The upper handle assembly 12 has a first end that is adapted to receive a lower jaw 16, and similarly, the lower handle assembly 14 has a first end that is adapted to receive an upper jaw 18. Both the upper and lower handle assemblies 12, 14 include second ends that may be covered with handle grips 20, 22. The upper and lower handle assemblies are interconnected by a tension arm 24.

Figure 2:
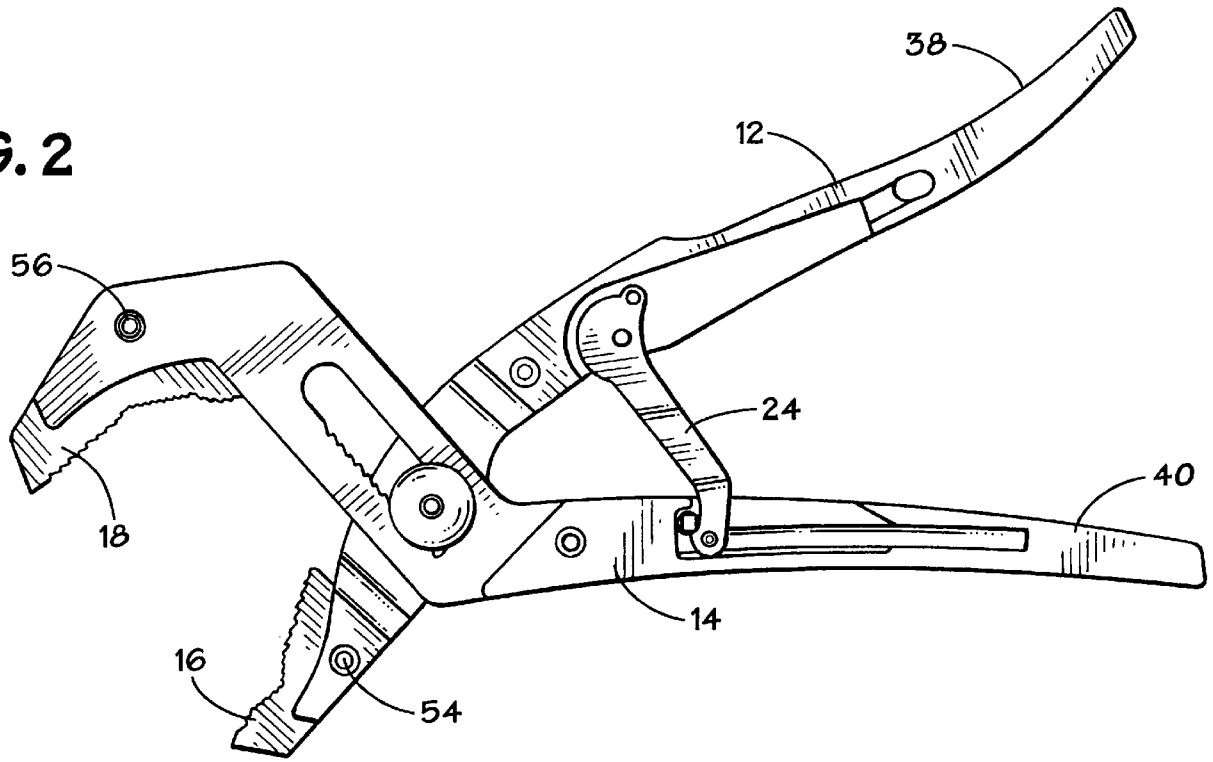
FIG. 2 is a side view of an embodiment of a self-adjusting pliers in accordance with an embodiment of the present invention, illustrating the jaws in a fully-opened position.
Figures 1, 4E:
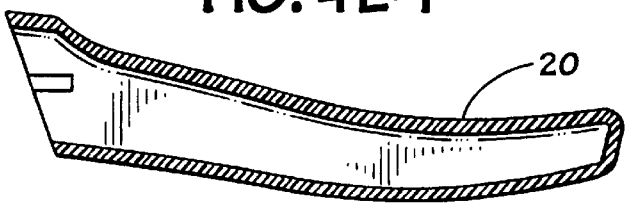
Figures 2, 4E:
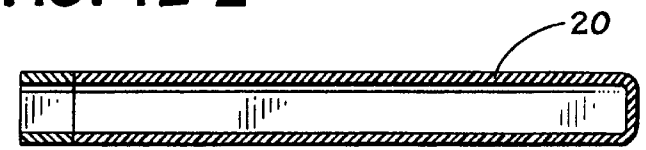
Figure 3:
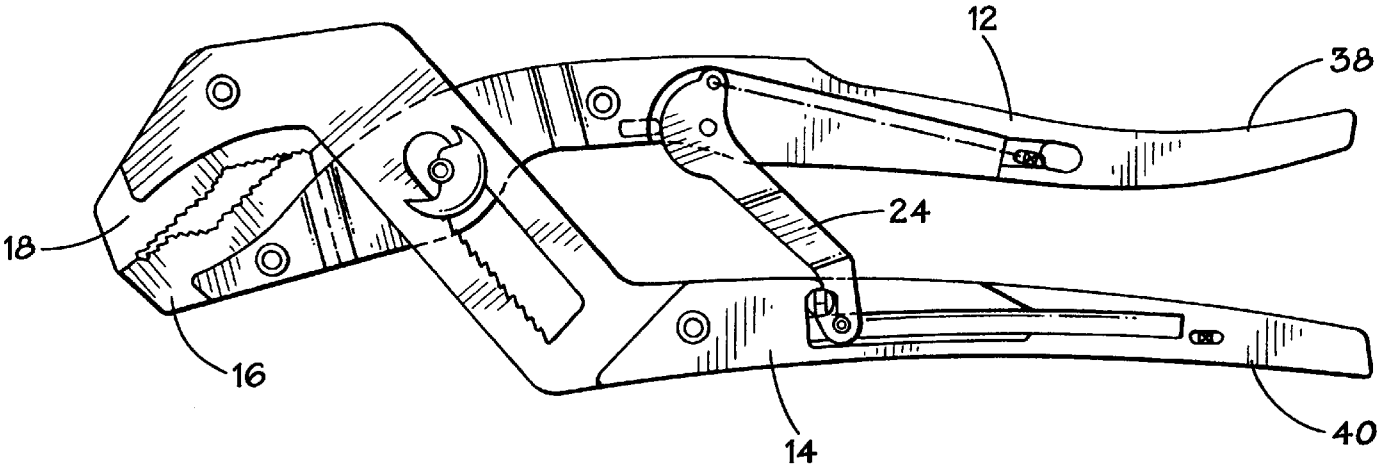
FIG. 3 is a side view illustrating the embodiment of the self-adjusting pliers of FIG. 2 with the jaws in a closed position.
Figures 1, 5E:
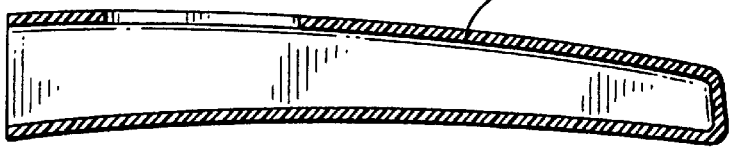
Figures 2, 5E:
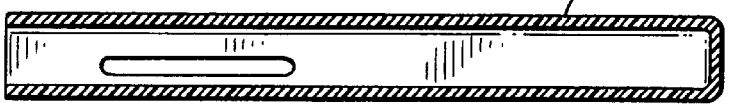
Figure 4A:
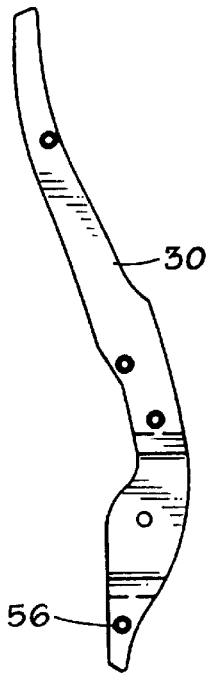
FIGS. 4A–4D illustrate first and second upper handle members in accordance with an embodiment of the present invention.
Figure 4B:
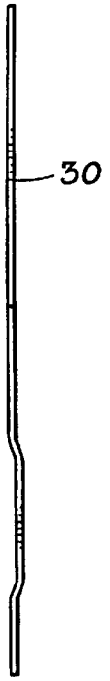
Figure 4C:
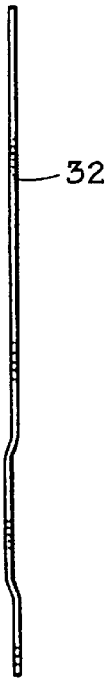
Figure 4D:
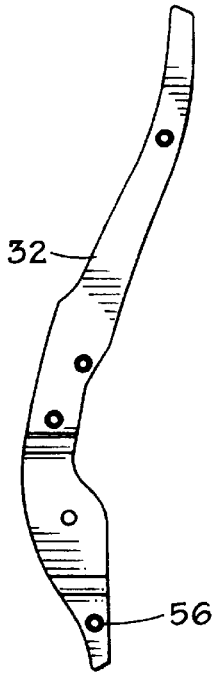
Figure 5A:
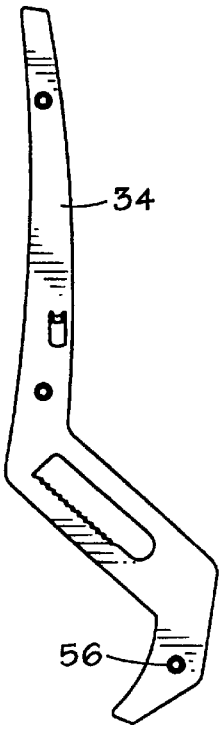
FIGS. 5A–5D illustrate first and second lower handle members in accordance with an embodiment of the present invention.
Figure 5B:
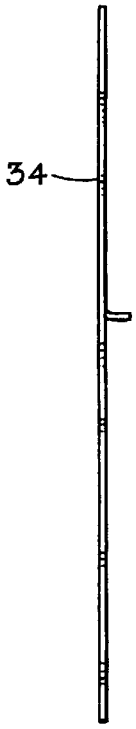
Figure 5C:
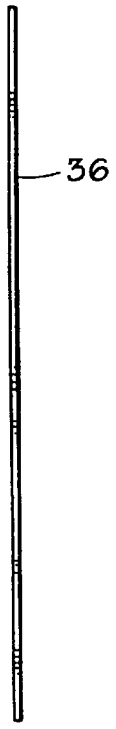
Figure 5D:
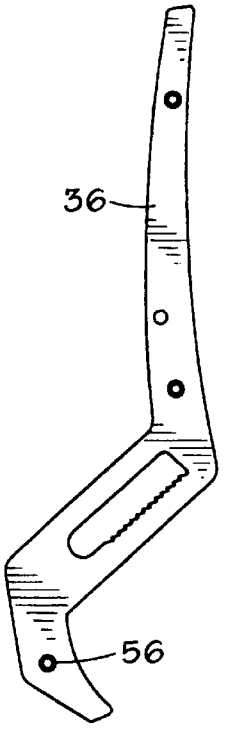

Referring to FIG. 2 and FIG. 3, the exemplary pair of self-adjusting pliers is illustrated with the jaws 16, 18 in fully opened and closed positions, respectively. The upper and lower handle assemblies 12, 14 each comprise first and second stamped metal members. FIGS. 4A and 4B illustrate an embodiment of the first upper handle member 30, while FIGS. 4C and 4D illustrate an embodiment of the second upper handle member 32. Similarly, FIGS. 5A–5C illustrate embodiments of first and second lower handle members 34, 36. Exemplary handle grips 20, 22 are illustrated in FIGS. 4E and SE, respectively. FIGS. 6A and 6B illustrate an embodiment of a tension arm.

Figure 7:
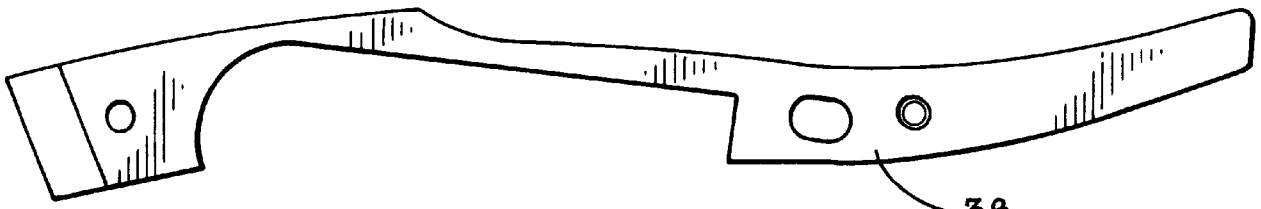
FIG. 7 is an assembly drawing illustrating an exemplary pivot lever handle insert in accordance with an embodiment of the present invention.
Figure 8:
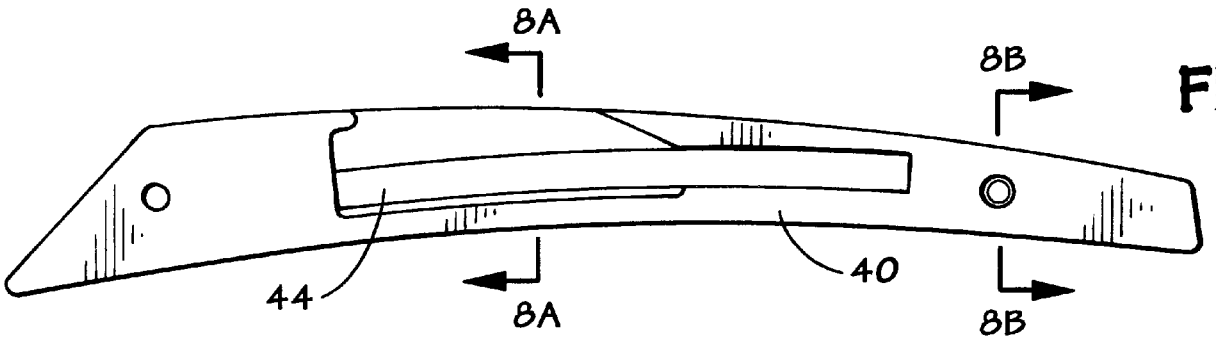
FIG. 8 is an assembly drawing illustrating an exemplary slotted lever insert in accordance with an embodiment of the present invention.
Figure 8B:
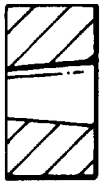
Figure 8A:
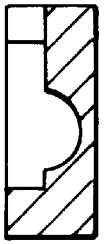

The pliers 10 is assembled in a laminated fashion. The construction of the upper and lower handle assemblies 12, 14 is essentially as described in above referenced U.S. Pat. No. 5,351,584, with the exception of the pliers' jaws, and with the addition of a disengaging feature that will be hereinafter described in detail. A pivot lever handle insert 38 is sandwiched between the first and second upper handle members 30, 32, and a slotted lever insert 40 is sandwiched between the first and second lower handle members 34, 36. Embodiments of the pivot lever handle insert 38 and the slotted lever insert 40 are illustrated in detail in FIG. 7 and FIG. 8, respectively.

A slotted lever compression spring 42 (illustrated in FIG. 9) is seated within a channel 44 defined by the slotted lever insert 40 such that it pushes against the portion of the tension arm 24 disposed within the lower handle assembly 14. A pivot lever extension spring 46 (illustrated in FIGS. 10A and 10B) has one end coupled to the portion of the tension arm 24 disposed within the upper handle assembly 12, and its other end coupled to the pivot lever handle insert 38 to bias the pliers jaws 16, 18 in an open position.

Figure 11B:
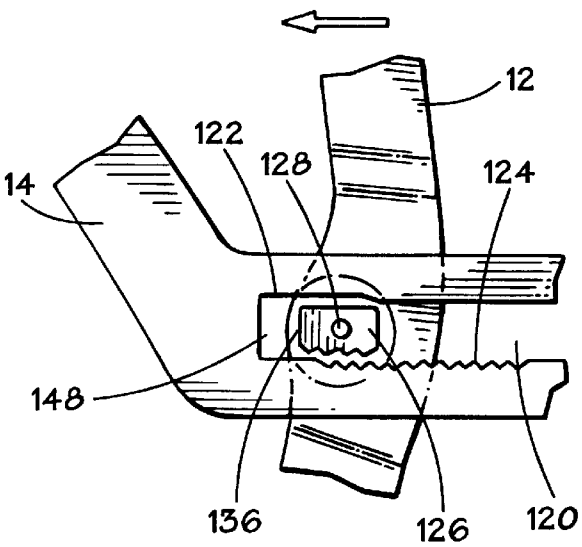
FIGS. 11A and 11B illustrate the operation of a nonengaging feature in accordance with an embodiment of the present invention.
Figure 11A:
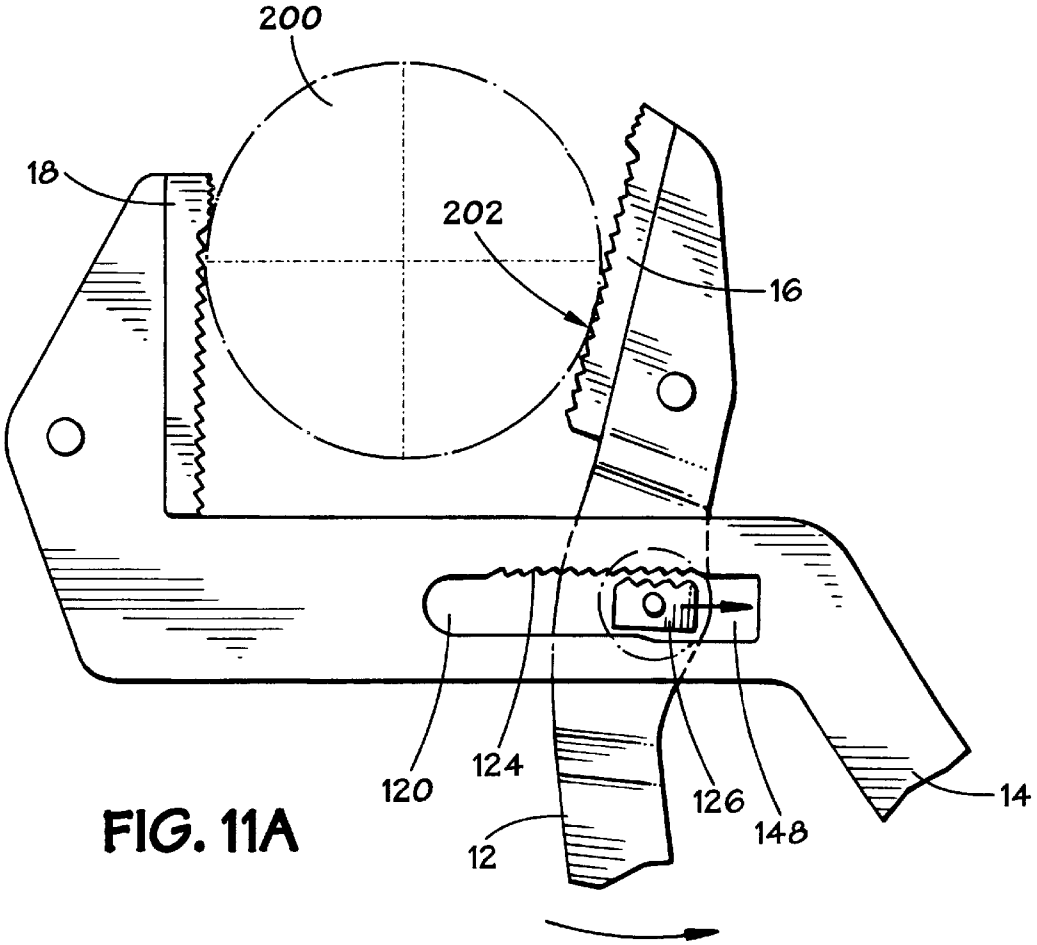
Figure 13A:
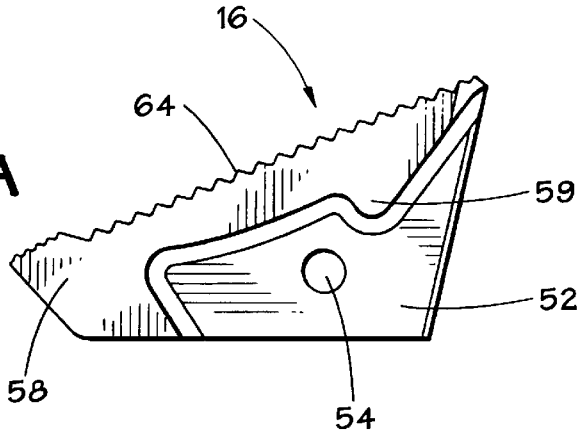
FIGS. 13A–13C illustrate an embodiment of a lower jaw in accordance with the present invention.
Figure 13B:
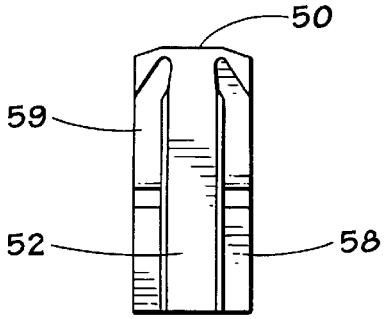
Figure 13C:
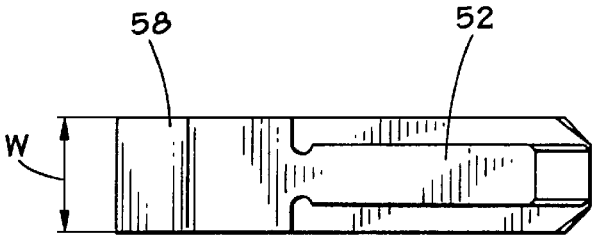

As shown in FIGS. 11A and 11B and as further explained in U.S. Pat. No. 4,651,598 and 4,893,530, the neck of lower handle assembly 14 comprises an elongated slot 120 in which a rotatable pawl 126 travels. Pawl 126 is carried on post 128, which is mounted on the neck of the upper handle assembly 12. When the user grasps the handles 12 and 14 and squeezes them together, the upper handle assembly 12 pivots on tension arm 24, allowing the jaws 16, 18 to close together. Pawl 126 slides along slot 120 until jaws 16 and 18 have contacted the workpiece 200; at that point the downward pressure on upper handle assembly 12 causes tension arm 24 to rotate slightly farther relative to lower handle assembly 14, pushing upper handle assembly 12 toward the neck of lower handle assembly 14. This forward motion in turn causes pawl 126 to engage the toothed track 124 of slot 120, impeding any further motion of pawl 126 and keeping handles 12 and 16 from sliding relative to one another. When pressure on the handles 12, 16 is released, the bias on tension arm 24 created by springs 42, 46 causes tension arm 24 to rotate to its original position, disengaging pawl 126 from track 124 and allowing the handles 12, 14 and jaws 16, 18 to move apart.

FIGS. 11A and 11B also demonstrate how a modification to the shape of the elongated slots in the lower handle assembly helps to increase the size of objects that a user may conveniently and comfortably grasp with the self-adjusting pliers tool. Ordinarily, the user can squeeze the handles 12, 14 of the pliers tool only slightly closer together once jaws 16 and 18 contact the opposing surfaces of a workpiece. As the lower handle rotates about its contact point 202 with workpiece 200, pawl 126 engages track 124. At the point of engagement the workpiece diameter, the handles 12, 14, and pawl 126 define a rigid quadrilateral, and the handles are prevented from collapsing together. It would thus be difficult for the user to grasp and manipulate large objects with one hand, because the handles would still be extremely far apart when engagement of the pawl locked them in their fixed relative position.

One way to overcome this problem is to prevent pawl 126 from engaging track 124 when jaws 16, 18 grasp an object in or near the fully opened position of the tool. The operation of this "nonengaging" feature will be described in terms of a single elongated slot and pawl, but it should be understood that the same modification may be implemented with identical effect in embodiments that have a slot and pawl on each side of the lower handle assembly. Slot 120 is provided with a nonengaging section 148 at the end of the slot where the pawl ordinarily lands when the tool is allowed to settle to its full-open position. This nonengaging section has two special features that help to prevent pawl 126 from engaging. First, the nonengaging section contains no teeth along the track side 124 of slot 120. Second, nonengaging section 148 is offset slightly from the center line of the main part of slot 120. As shown in FIG. 11A, when jaws 16, 18 close on an object 200, upper handle assembly 12 rotates about the contact point 202 between jaw 16 and the object, and pawl 126 is rotated into engagement with track 124. If the jaws are far enough apart to activate the nonengaging feature, however, the leading tooth 136 of pawl 126 misses the toothed part of track 124 and does not engage. Instead, tooth 136 contacts the edge of slot 120 beyond track 124, causing the pawl to rotate on post 128 to an orientation that permits it to enter the offset portion of slot 120. The downward force on upper handle 12 causes pawl 126 to slide along the smooth back edge portion 122 of slot 120 into nonengaging section 148. As the pliers handles 12, 14 are squeezed further together, upper handle 12 and lower jaw 16 remain free to continue rotating about the jaw contact point 202, and pawl 126 continues to slide until it reaches a terminal or bottomed-out position at the far end of section 148. When pawl 126 reaches this position, the handles 12, 14 are stopped from collapsing further. The nonengaging feature thus allows the user to squeeze the handles much closer together, and thereby to achieve and maintain a much more comfortable grip on large diameter objects than would be possible without this feature.

In keeping with the general principle of laminated construction, the lower jaw 16 is sandwiched between the first and second upper handle members 30, 32, and the upper jaw 18 is sandwiched between the first and second lower handle members 34, 36. Embodiments of the upper jaw 18 and the lower jaw 16 are illustrated in detail in FIGS. 12A–12C and FIGS. 13A–13C, respectively. The upper and lower jaws 18, 16 each include a toothed jaw surface 50 and a jaw extension portion 52. The jaw extension portions 52 each define a bore 54 therethrough. The first ends of the upper and lower handle assemblies 12, 14 each define corresponding bores 56 therethrough, such that a fastening member, such as a rivet, extends through the bores 54 and 56 to fasten the lower and upper jaws 16, 18 between the first and second members 30, 32, 34, 36 of the upper and lower handle assemblies 12, 14.

In the illustrated embodiment, the width of the toothed jaw surface 50 (denoted "W" in FIGS. 12C and 13C) is greater than the distance between the first and second handle members 30, 32, 34, 36 when placed in their assembled position with the jaw extension portions 52 sandwiched therebetween. As such, the first and second handle members 30, 32, 34, 36 support their respective lower and upper jaw 16, 18. The lower and upper jaws 16, 18 each further include a "nose" portion 58 having a width approximately the same as the toothed jaw surface 50. The nose portions 58 extend around the tips of the respective first and second handle members 30, 32, 34, 36 holding the jaws 16, 18 to further support the jaws 16, 18 in place, preventing the jaws 16, 18 from being pushed out of place when the pliers 10 is being used.

In some embodiments of this invention, the jaws 16, 18 are held in place in the end of the handle assembly primarily by means of one or more rivets or other fasteners extending through bores 54, 56. When the jaw is subjected to a heavy load, the shear stress is concentrated at the rivet, and it is possible for the rivet to deform or shear. In another embodiment of the invention, the jaws are shaped to interlock with the jaw end of the handle assembly. In this embodiment, shown in FIGS. 12A–12C and 13A–13C, an L-shaped notch is formed at the back of the jaw end of the handle assembly—that is, the part of the jaw end closest to the neck of the handle. The jaw is fabricated to include in its handle contact surface a corresponding projection 59 that fills the notch. This interlocking feature provides an additional mechanism to prevent the jaw from sliding along the jaw end of the handle, thus preventing the fastener from loosening. Furthermore, the shape of the jaw distributes the shear load on the jaws over the entire end rather than concentrating the load at the fasteners.

The effectiveness of the interlocking feature is further enhanced if the jaw also includes a nose portion 58 that extends around the tips of the handle members 30, 32, 34, 36 as previously described. In addition, the interlocking feature works especially well when the edge of the jaw end between the handle tip and the notch is curved inward slightly.

In certain embodiments of the present invention, depicted in FIGS. 14A–14E and 15A–15D, and 21, the upper and lower jaws 18, 16 further include a novel, "self-energizing" feature, whereby the jaws 16, 18 continue to hold a work piece with only a downward force being applied to the upper handle 12, even after squeezing force is released. For example, the jaws 16, 18 of the pliers 10 may be placed about a work piece, such as a pipe. The jaws 16, 18 self-adjust to the proper distance apart through the user's closing action on the pliers' handles 12, 14. Once the jaws 16, 18 "bite" into the pipe, the pliers 10 will continue to hold the pipe even after squeezing force is released, as long as downward force is maintained on the upper handle 12.

Figure 21:
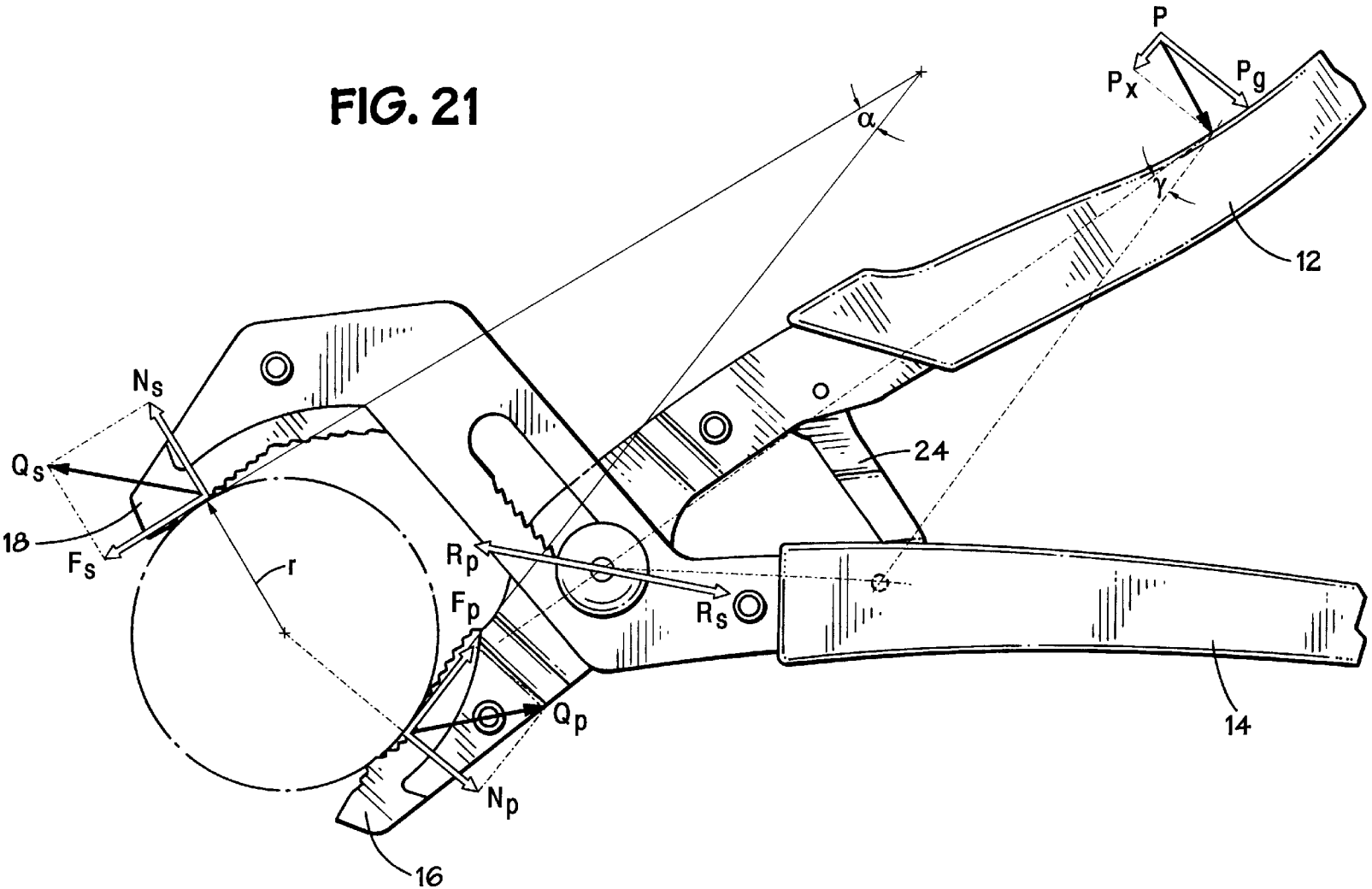
FIG. 21 is a vector diagram depicting the forces on the pliers and on a workpiece and demonstrating the operation of the pliers' "self-energizing" feature.

As shown in FIG. 21, the forces $Q_s$, $Q_p$ on the work piece can be resolved into normal forces $N_s$, $N_p$ and tangential forces $f_s$, $f_p$. The relationship between the normal and tangential forces is similar to the familiar relationship between normal and frictional forces. In other words, the greater the normal force, the deeper the jaws "bite" into the work piece, and the greater the tangential force. However, the relationship is not necessarily linear. The self-energizing state is achieved when all of the forces on the pliers are balanced; that is, when the load P applied to the upper handle 12 is balanced by $Q_p$ and reaction force $R_p$, and forces $Q_s$ and $R_s$ on the lower handle 14 also balance. This self-energizing state is maintained as long as the tangential force $f_p$ or $f_s$ necessary to achieve the balance is less than the maximum tangential force that can be generated by the normal force. Therefore, the self-energizing state may be attained either by increasing the maximum available tangential force, for example by using sharper teeth, or preferably by designing the pliers geometry so as to reduce the magnitude of tangential force that is required to balance the force applied to the handle. The latter approach is preferred over the former because it does not depend on the sharpness of the teeth, which may diminish after extended use of the pliers. The required tangential force is reduced when the angle formed between the jaw and neck portions of lower handle 12 is decreased. However, the gripping range of the pliers (that is, the maximum diameter of a workpiece that may be grasped) also decreases as this angle decreases. A suitable balance is achieved when the angle is approximately 90 degrees.

Figure 15A:
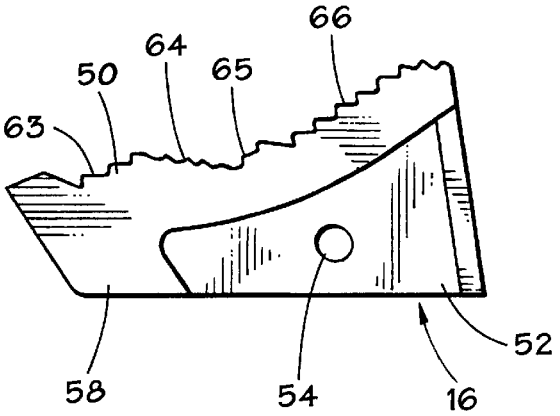
Figure 14C:
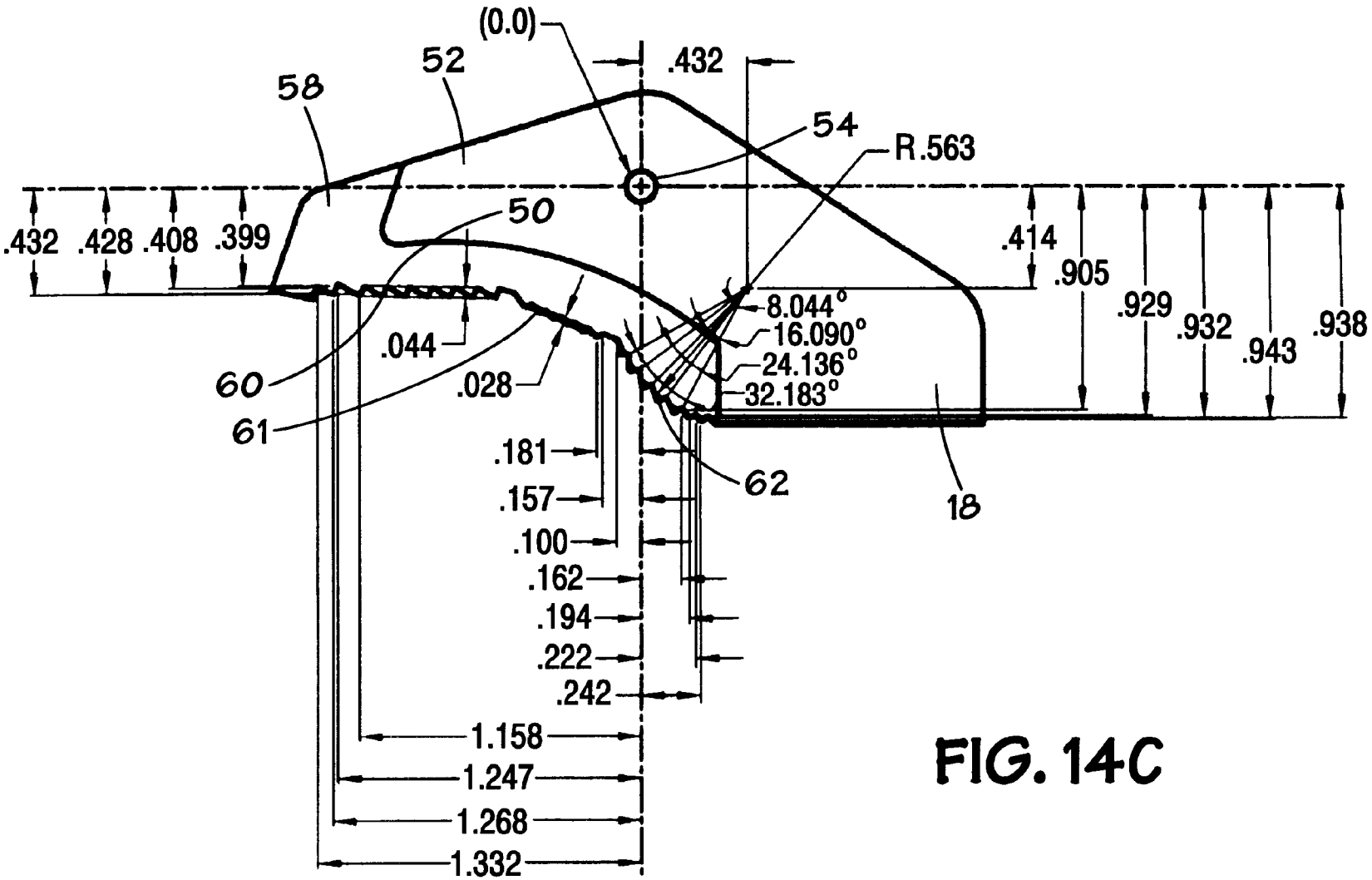
Figure 15C:
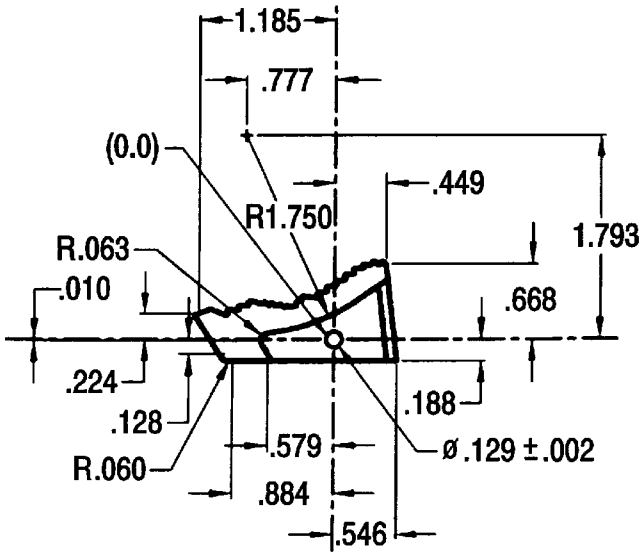
Figure 15D:
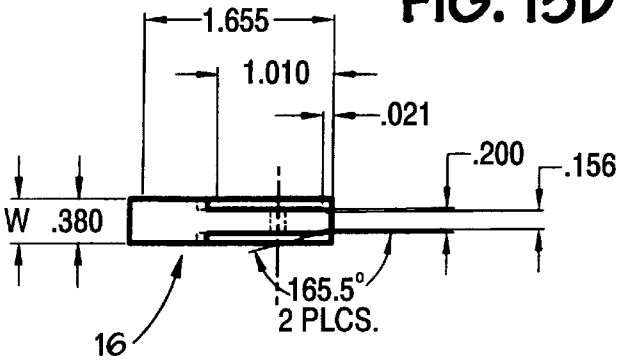
Figure 14D:
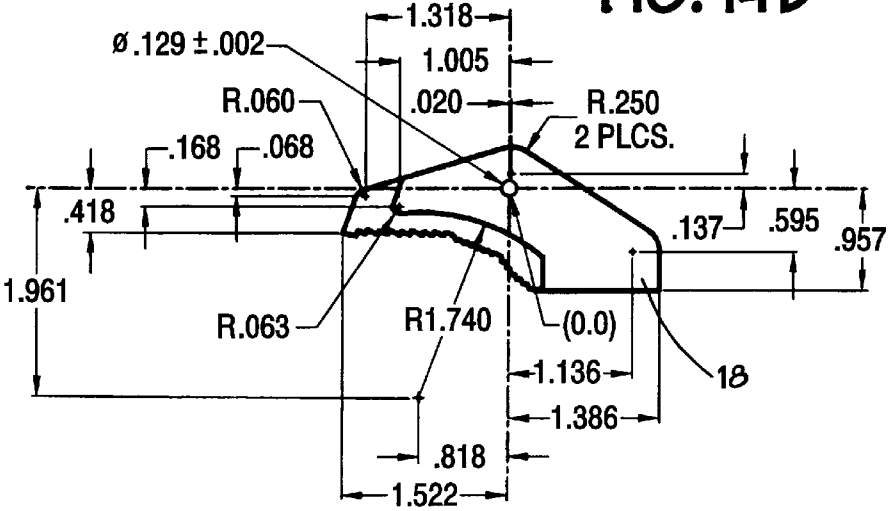
Figure 14E:
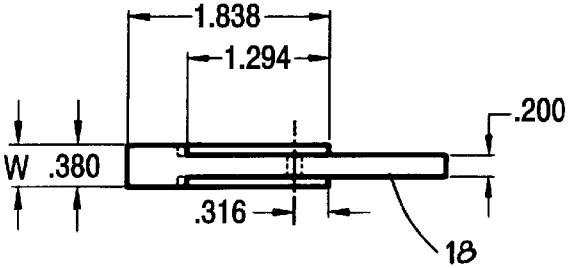
Figure 15B:
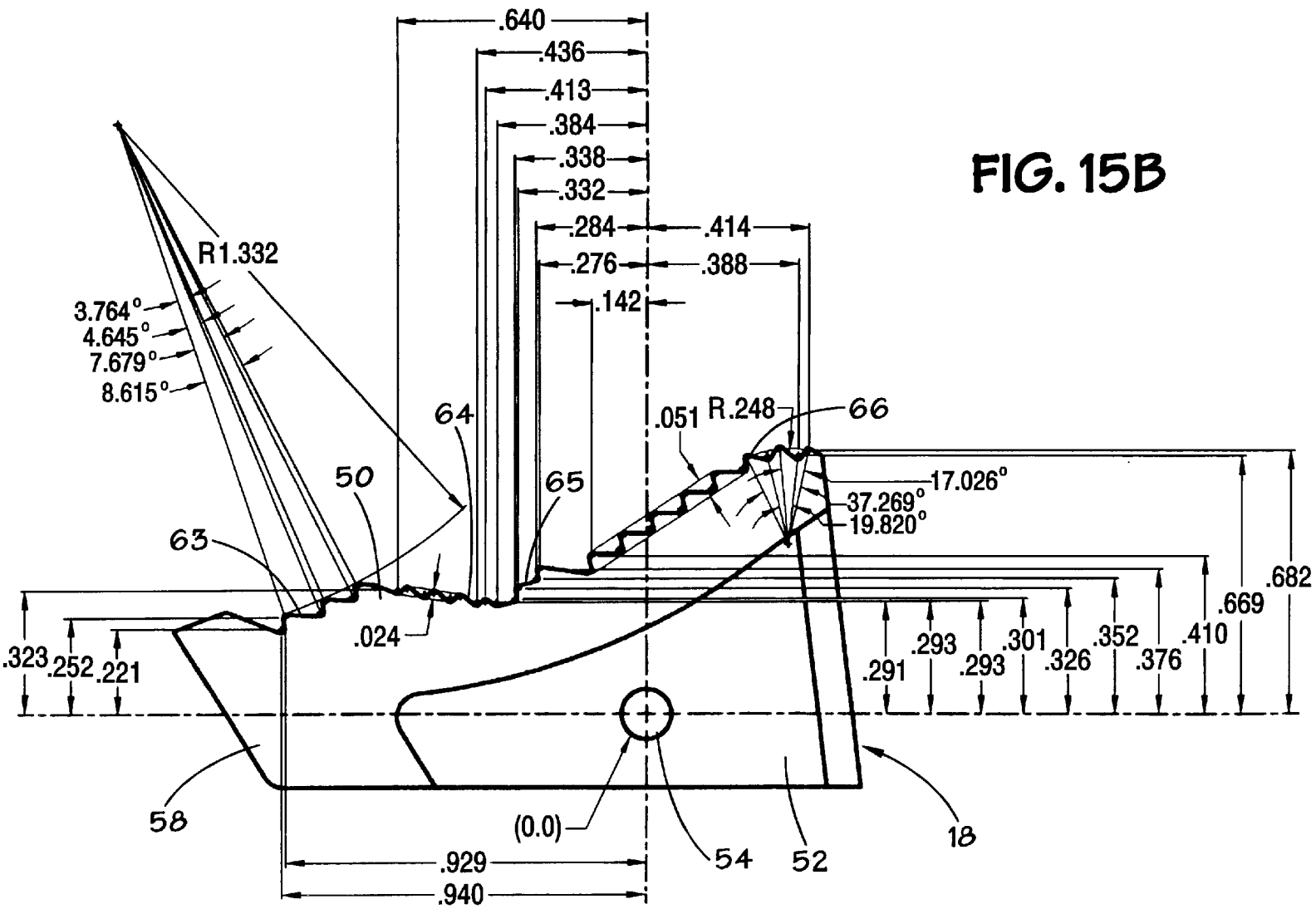
Figure 16A:
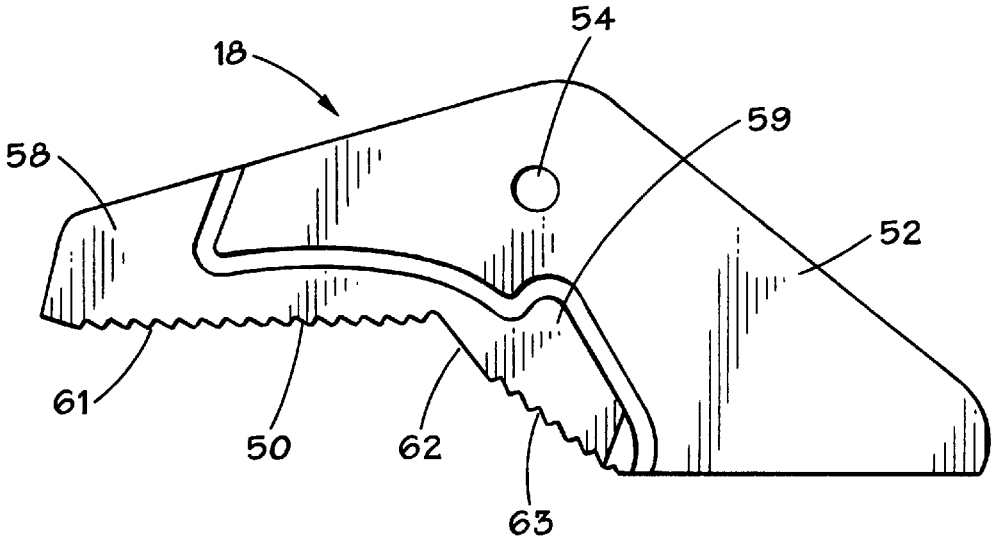
FIGS. 16A–16C and 17A–17C illustrate an embodiment of upper and lower jaws, respectively, having both the self-energizing and interlocking features of the present invention.
Figure 16C:
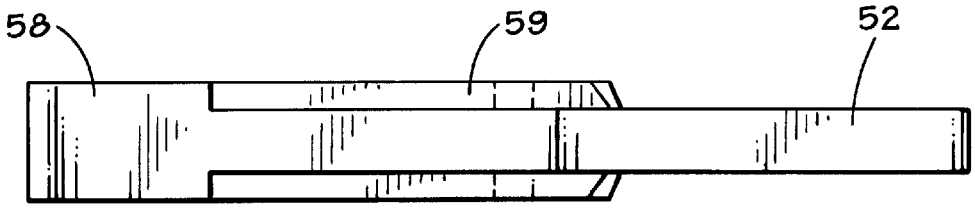
Figure 16B:
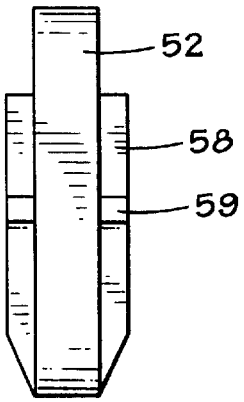
Figure 17A:
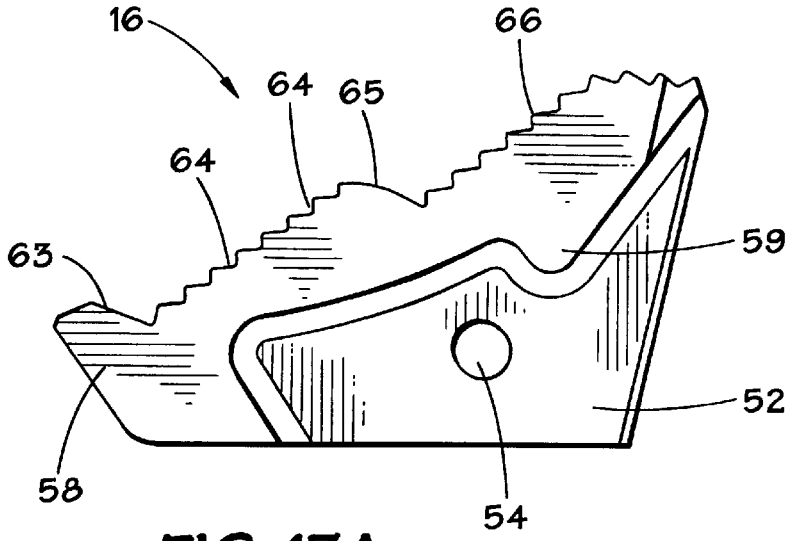
Figure 17B:
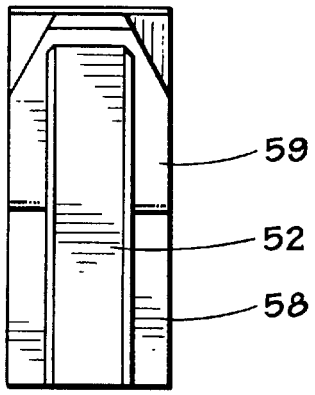
Figure 17C:
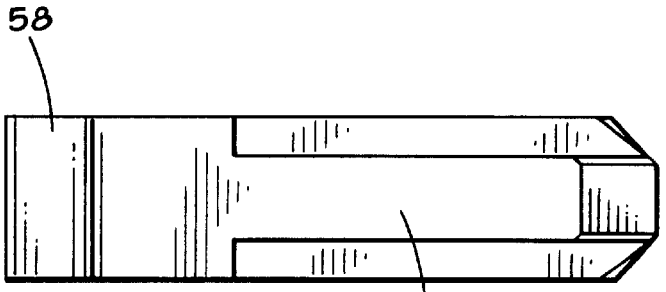

FIGS. 14A, 14B, and 15A depict an embodiment of the pliers jaws in accordance with the invention in which the configuration of the teeth is conducive to jaw self-energization. The toothed jaw surface 50 of the upper jaw 18 defines three distinct sections of teeth 60, 61, 62, and the toothed jaw surface 50 of the lower jaw 16 defines four sections of teeth 63, 64, 65, 66. The specific dimensions and configurations for the toothed jaw surfaces 50 are as displayed on the assembly drawings of FIGS. 14C–14E and FIGS. 15B–15D. The various sizes, arrangements, locations, etc. of the teeth relative to the jaws 16, 18 contribute to maximizing the available tangential force such that self-energization may be achieved.

Both the jaws 16, 18 are of a cast construction. In one embodiment of the invention, the net shape of the pliers jaws 16, 18 are fabricated out of H-13 tool steel using an investment casting process. H-13 steel has high chromium and low vanadium content, providing strength and toughness when heat treated properly. Disposable wax patterns of the pliers jaws 16, 18 are coated with ceramic materials to form a thin mold. After removal of the wax, the mold is heated (fired) to a high temperature to prepare it for receiving the molten tool steel. The molten metal is poured into the mold, and after the metal has cooled to ambient temperature, the ceramic mold is destroyed to recover the net-shape cast pliers jaws.

The specific properties of the cast pliers jaws are dependent upon the degree to which the various processes are controlled. For example, mold firing temperature and metal pouring temperature must be closely controlled to achieve a high degree of soundness required for the pliers jaws. In one casting process in accordance with an embodiment of the invention, the H-13 steel is melted and kept at a temperature of about 3,000° F. before being poured into the ceramic mold. The mold is preheated to a temperature of about 1,900° F. Also, the surfaces of the castings must be protected against excessive oxidation. This is accomplished using "canning" processes to protect the solidifying castings.

Figure 18:
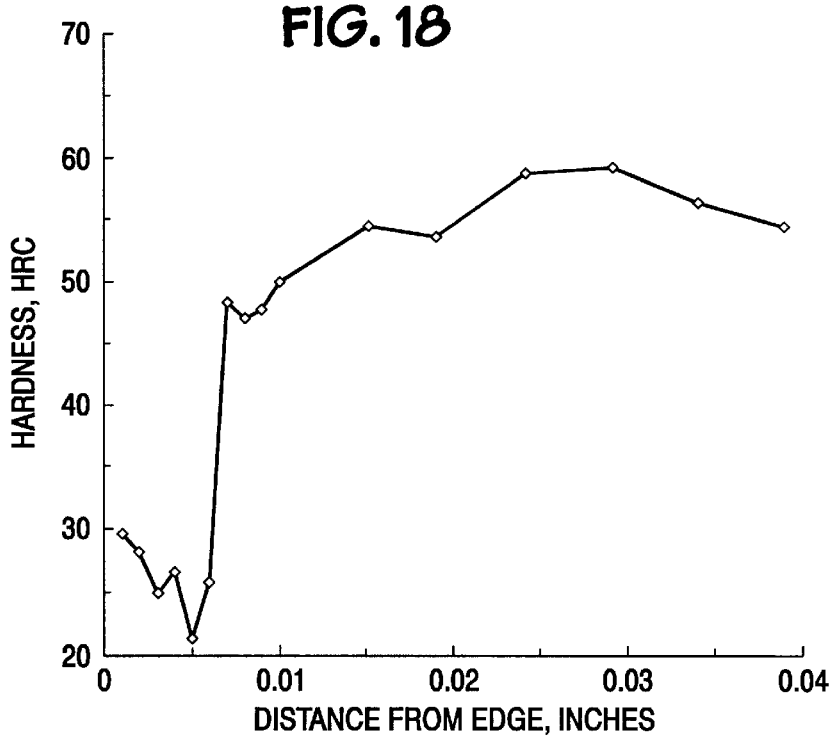
FIG. 18 is a graph displaying microhardness vs. distance from the pliers jaw edge for pliers jaw castings fabricated in accordance with aspects of the present invention, prior to surface hardening processes.

The cast pliers jaws are heat treated to produce a tough core structure and a hard, wear resistant surface. The jaws 16, 18 are heat treated via vacuum heat treating, improving the repeatability of the treatment conditions during subsequent treatment cycles. The hardening temperature in the exemplary heat treating process is about 1,850° to 1,875° F. The pliers jaw castings are then vacuum quenched and tempered at 1050° F. for about 2 hours. This results in both the core and the surface being hardened to about 46–48 Rc. FIG. 18 illustrates a microhardness profile of an embodiment of the pliers jaws, prior to any surface hardening processes. As shown in FIG. 18, the hardness generally increases as the distance from the casting surface increases.

A fluidized bed system is then used to achieve surface hardening of the pliers jaws. In an exemplary surface hardening process, a nitrocarburizing process is used. The process is performed in an atmosphere containing ammonia, natural gas (methane) and nitrogen, for about four hours at about 1,000° F. This surface hardening treatment also serves as a second temper for the jaw castings. Thus, the process of the present invention results in pliers jaws 16, 18 having a case, or surface, hardness of about 70 Rc, yet with a ductile, tough inner core having a hardness of about 45–50 Rc.

In one embodiment of the invention, the case is about 0.002 to 0.004 inches. In other words, the surface of the pliers jaws 16, 18 is hardened to a depth of about 0.002 to 0.004 inches from the surface of the jaws 16, 18. Other embodiments include cases that extend to about 0.006 inches. The exemplary nitrocarburizing process results in a minimal "white layer," which is a brittle byproduct of nitriding. If the nitrocarburizing process creates a case greater than about 0.006 inches, the white layer may increase, causing the undesirable result of the outer surface being brittle. Further, if the case extends to the point that it encapsulates entire jaw teeth, the white layer created may, in turn, result in brittle teeth on the pliers jaws 16, 18. A case depth of about 0.002 to 0.004 inches results in adequate surface hardness for typical applications, while creating only a minimal white layer.

Figure 19:
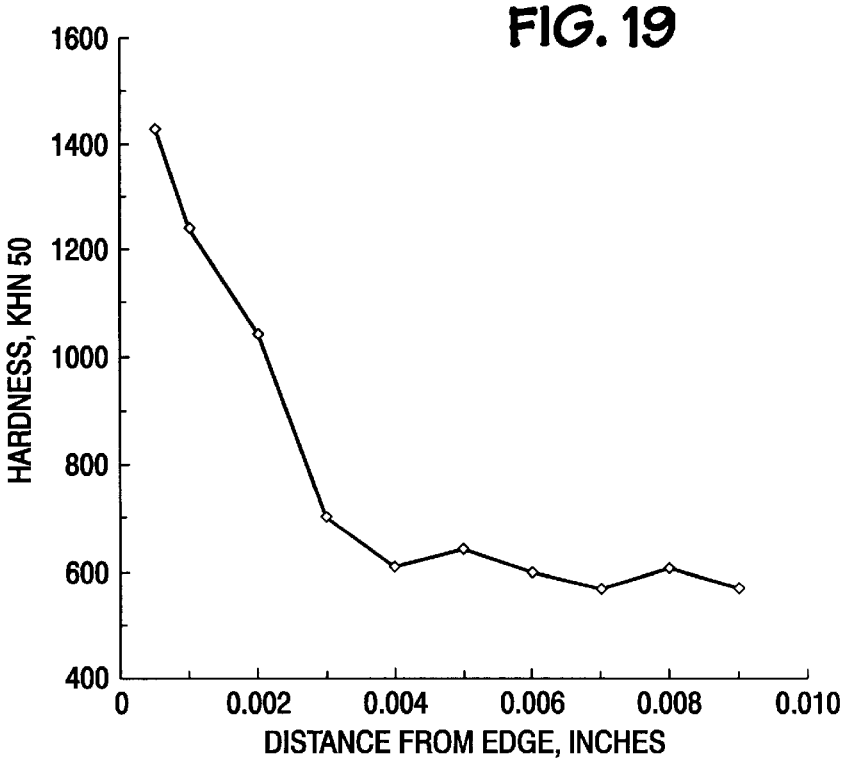
FIG. 19 is a graph displaying microhardness vs. distance from the pliers jaw edge for pliers jaw castings fabricated in accordance with aspects of the present invention, including surface hardening processes.

FIG. 19 is a graph illustrating microhardness expressed in units of KHN 50 (Knoop Hardness Number, 50 gm. load) versus distance from the pliers jaw surface. The hardness measurements shown in FIG. 19 reflect castings heat treated for one hour at about 1,850° F., then vacuum quenched and double tempered for about two hours at 1,120° F. The castings were then surface hardened by a nitrocarburizing process for about four hours at 1,000° F. As shown in FIG. 18, at a distance of about 0.0005 inches from the casting edge, the hardness is over 1,400 KHN (well over 70 Rc). At a distance of about 0.004 inches from the casting edge, however, the hardness has dropped to about 600 KHN (about 53 Rc). FIG. 20 illustrates microhardness for a sampling of pliers jaws fabricated in accordance with the present invention. The sample pliers jaws have a case depth of about 0.006 inches. As shown in FIG. 20, the hardness of the jaws is generally greater than 70 Rc near the surface, and decreases to about 50 Rc at distances closer to the core.

A further advantage imparted by the jaw fabrication method described above is that of superior corrosion resistance. As indicated in Table 1, the nitrocarburized jaw and a commercial Channellock® plier were tested according to the ASTM D-1735 corrosion test. The Channellock® plier showed 20% rust after 120 hours of exposure; but the nitrocarburized jaw developed no rust spots until 240 hours of exposure, and only 16 spots (less than 1% rust) after 360 hours.

TABLE 1

Comparative corrosion test data per ASTM D-1735

| Time (hours) | Channellock ® 10" Plier Model 430 | Nitrocarburized Jaw | Vibratory-treated Handle |
|---|---|---|---|
| 24 | 5% rust | | |
| 48 | 10% rust | | |
| 72 | 10% rust | | |
| 120 | 20% rust | | |
| 240 | | 2 spots | |
| 312 | | 4 spots | 2 spots |
| 336 | | 9 spots | 4 spots |
| 360 | | 16 spots | 4 spots |

The described embodiment of the exemplary pair of pliers in accordance with the present invention achieves the economy of a stamped steel, laminated construction, while providing improved jaws. Alloy tool steel is used for the jaws, facilitating an efficient casting process for the jaws that eliminates the waste associated with prior art forging processes. Further, the use of alloy tool steel for the pliers jaws promotes the use of a heat treating process, such that the surface of the jaws are hardened while maintaining the necessary ductility and toughness of the core portion of the jaws.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention.

What is claimed is:

1. A self-adjusting pliers tool comprising:

an upper handle assembly comprising a handle portion, a jaw portion, and an intermediate neck portion;

a lower handle assembly comprising a handle portion, a jaw portion, and an intermediate neck portion having an elongated slot, said slot comprising first and second sidewalls and a series of equally spaced projections along a portion of said first sidewall;

a connecting assembly connecting the upper and lower handle assemblies, said connecting assembly being mounted on the neck portion of said upper handle assembly and adapted to slide within the elongated slot of said lower handle assembly and to move from a first position, in which said connecting assembly engages said projections in the elongated slot to restrain the connecting assembly from sliding, to a second position, in which said connecting assembly and said projections are disengaged; and biasing means coacting between the upper and lower handle assemblies and normally urging the jaw portions to slide away from one another to a full open position, wherein said elongated slot comprises a nonengaging region at an end of the slot toward which the connecting assembly is urged by the biasing means, said slot having no projections along the first or second sidewall thereof in said nonengaging region;

said nonengaging region further comprising an offset in the second sidewall of the slot such that the connecting assembly moves away from the projections when the connecting assembly enters the nonengaging region.

2. The pliers tool of claim 1, wherein the handle and neck portions of said upper and lower handle assemblies are of laminated construction, and wherein the jaw portion of each of said handle assemblies comprises at least two layers extending from the corresponding neck portion and a solid jaw piece disposed between the two layers.

3. The pliers tool of claim 1, wherein each of said jaw pieces comprises:

a gripping surface having teeth;

two handle contact surfaces disposed opposite the gripping surface;

an extension portion extending from between the handle contact surfaces, adapted for disposal in the first end of one of the handle assemblies between the end layers, and defining a bore therethrough adapted to receive a fastener.

4. The pliers tool of claim 3, wherein each of said first end layers has a tip, and wherein at least one of said jaw pieces further comprises a tip portion wider than the extension portion and extending beyond the tips of the first end layers.

5. The pliers tool of claim 3, wherein each of said handle contact surfaces comprises a protrusion toward said extension portion, said protrusion adapted to fit into a notch in a first end layer of one of the handle assemblies, and said notch and protrusion adapted to cooperate to impede the jaw from sliding along the handle ends.

6. The pliers tool of claim 5, wherein the jaws comprise a surface having a thickness of about 0.002 to about 0.004 inches and a hardness of about 70 Rc surrounding a core having a hardness of about 45 to 50 Rc.

7. The pliers tool of claim 1, wherein the jaws comprise a surface having a thickness of about 0.002 to about 0.004 inches and a hardness of about 70 Rc surrounding a core having a hardness of about 45 to 50 Rc.

* * * * *